US007563080B2

(12) United States Patent
Masuda

(10) Patent No.: US 7,563,080 B2
(45) Date of Patent: Jul. 21, 2009

(54) ROTARY COMPRESSOR

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 420 days.

(21) Appl. No.: 10/572,511

(22) PCT Filed: May 11, 2005

(86) PCT No.: PCT/JP2005/008633

§ 371 (c)(1),
(2), (4) Date: Mar. 17, 2006

(87) PCT Pub. No.: WO2005/108793

PCT Pub. Date: Nov. 17, 2005

(65) Prior Publication Data

US 2007/0041852 A1 Feb. 22, 2007

(30) Foreign Application Priority Data

May 11, 2004 (JP) ..... 2004-140691

(51) Int. Cl.
*F04B 17/00* (2006.01)

(52) U.S. Cl. ..... 417/410.3; 418/57; 418/59

(58) Field of Classification Search ..... 417/375, 417/410.1, 413.3, 410.3; 418/57–59
See application file for complete search history.

(56) References Cited

U.S. PATENT DOCUMENTS 4,553,903 A * 11/1985 Ashikian ..... 417/204
4,629,403 A * 12/1986 Wood ..... 418/1
4,636,152 A * 1/1987 Kawaguchi et al. ..... 418/54
5,011,386 A * 4/1991 Guttinger ..... 418/59
5,399,076 A * 3/1995 Matsuda et al. ..... 418/6
5,472,327 A * 12/1995 Strikis et al. ..... 418/15
5,605,477 A * 2/1997 Wu et al. ..... 439/620.24
6,077,058 A * 6/2000 Saitou et al. ..... 418/66
6,676,392 B1 * 1/2004 Hwang et al. ..... 418/59
6,932,588 B2 * 8/2005 Choi et al. ..... 418/63
6,962,486 B2 * 11/2005 Lee et al. ..... 417/218
2004/0161345 A1 * 8/2004 Choi et al. ..... 417/298

FOREIGN PATENT DOCUMENTS

JP 60-92789 U 6/1985
JP 60-92789 U * 6/1985
JP 60-142090 A 7/1985

(Continued)

*Primary Examiner*—Devon C Kramer
*Assistant Examiner*—Todd D Jacobs
(74) *Attorney, Agent, or Firm*—Global IP Counselors

(57) ABSTRACT

A rotary compressor includes a rotation mechanism, an annular piston and a blade. The rotation mechanism has a cylinder with an annular cylinder chamber. The annular piston is contained in the cylinder chamber eccentrically from the cylinder and sectioning the cylinder chamber into an outer compression chamber and an inner compression chamber. The blade is disposed in the cylinder chamber and sectioning each of the inner and outer compression chambers into a high-pressure side and a low-pressure side. The rotation mechanism compresses a fluid by relatively rotating the cylinder and the piston. The outer compression chamber serves as a low-stage side compression chamber for compressing a low-pressure fluid into an intermediate-pressure fluid. The inner compression chamber serves as a high-stage side compression chamber for compressing the intermediate-pressure fluid compressed in the low-stage side compression chamber into a high-pressure fluid.

7 Claims, 9 Drawing Sheets

FOREIGN PATENT DOCUMENTS

| | | | | |
|---|---|---|---|---|
| JP | 61-073001 | U | | 5/1986 |
| JP | 61-116184 | U | | 7/1986 |
| JP | 10-131880 | A | | 5/1998 |
| JP | 2001-207983 | A | | 8/2001 |
| JP | 2001207983 | A | * | 8/2001 |
| JP | 2002-021729 | A | | 1/2002 |
| JP | 2003-293971 | A | | 10/2003 |
| JP | 2004-125186 | A | | 4/2004 |
| WO | WO-02/088529 | | | 7/2002 |

* cited by examiner

ROTARY COMPRESSOR

CROSS-REFERENCE TO RELATED APPLICATIONS

This U.S. National stage application claims priority under 35U.S.C. §119(a) to Japanese Patent Application No. 2004-140691, filed in Japan on May 11,2004, the entire contents of which are hereby incorporated herein by reference.

TECHNICAL FIELD

The present invention relates to a rotary compressor and more particularly relates to a rotary compressor for compressing a fluid in two stages.

BACKGROUND ART

Conventionally, as disclosed in Japanese Unexamined Patent Publication No. 2003-293971, some of rotary compressors each include first and second rotary compressor elements and compress a refrigerant in two stages. The first and second rotary compressor elements are each configured such that a rotor and a blade are accommodated in a cylinder and a refrigerant is compressed by rotating the rotor in the cylinder. Furthermore, the refrigerant is compressed by the first rotary compressor element and then compressed by the second rotary compressor element. In other words, the refrigerant is compressed in two stages by the first and second rotary compressor elements. As a result, an efficient operation is performed.

SUMMARY OF THE INVENTION

Problems that the Invention is to Solve

However, since, in a known rotary compressor, first and second rotary compressor elements are vertically arranged in different planes, the size of the whole compressor and the number of components are increased. In other words, since the first and second rotary compressor elements are vertically and separately arranged, the height of the whole compressor is increased. Furthermore, since the first and second rotary compressor elements are completely separately formed and do not include any common component, the number of components of the whole compressor is large.

The present invention has been made in view of the above problems, and an object of the present invention is to reduce the number of components of a rotary compressor and downsize the whole rotary compressor.

Means of Solving the Problems

As illustrated in FIG. 1, a rotary compressor of a first aspect of the present invention comprises a rotation mechanism (20) including a cylinder (21) having an annular cylinder chamber (50); an annular piston (22) contained in the cylinder chamber (50) eccentrically from the cylinder (21) and sectioning the cylinder chamber (50) into an outer compression chamber (51) and an inner compression chamber (52); and a blade (23) disposed in the cylinder chamber (50) and sectioning each said compression chamber (51, 52) into a high-pressure side and a low-pressure side, said rotation mechanism (20) compressing a fluid by relatively rotating the cylinder (21) and the piston (22). One of the two compression chambers (52, 51) serves as a low-stage side compression chamber (51) for compressing a low-pressure fluid into an intermediate-pressure fluid. The other of the two compression chambers (52, 51) serves as a high-stage side compression chamber (52) for compressing the intermediate-pressure fluid compressed in the low-stage side compression chamber (51) into a high-pressure fluid.

According to the first aspect of the present invention, the driving of the rotation mechanism (20) allows the cylinder (21) and the piston (22) to relatively rotate, and the volumes of the low-stage side compression chamber (51) and the high-stage side compression chamber (52) are reduced to compress a fluid. To be specific, a fluid is compressed in the low-stage side compression chamber (51) and then further compressed in the high-stage side compression chamber (52).

The invention according to a second aspect provides the rotary compressor of the first aspect, wherein the outer compression chamber (51) serves as the low-stage side compression chamber (51), and the inner compression chamber (52) serves as the high-stage side compression chamber (52).

According to the second aspect of the present invention, the volume of the high-stage side compression chamber (52) inevitably becomes smaller than that of the low-stage side compression chamber (51). As a result, the low-stage side compression chamber (51) and the high-stage side compression chamber (52) have substantially the same maximum compression torque, resulting in reduced vibration.

The invention according to a third aspect provides the rotary compressor of the first aspect further comprising a casing (10) containing the rotation mechanism (20), wherein an intermediate-pressure space (4*b*) into which the intermediate-pressure fluid compressed in the low-stage side compression chamber (51) is introduced is formed inside the casing (10), and a gas injection pipe (1*c*) through which a gas is injected into the intermediate-pressure space (4*b*) is connected to the casing (10).

According to the third aspect of the present invention, in the intermediate-pressure space (4*b*), for example, a gas refrigerant is supplied through the intercooler and the gas injection pipe (1*c*) to the intermediate-pressure fluid.

The invention according to a fourth aspect provides the rotary compressor of the first aspect further comprising a driving mechanism (30) for driving the rotation mechanism (20), wherein the rotation speed of the driving mechanism (30) is variably controlled.

According to the fourth aspect of the present invention, the volumes of the low-stage side compression chamber (51) and the high-stage side compression chamber (52) are adjusted by controlling the rotation speed of the driving mechanism (30).

The invention according to a fifth aspect provides the rotary compressor of the first aspect further comprising a casing (10) containing the rotation mechanism (20). The casing (10) is formed internally with an intermediate-pressure space (4*b*) into which the intermediate-pressure fluid compressed in the low-stage side compression chamber (51) is introduced and a high-pressure space (4*a*) into which a high-pressure fluid obtained by compressing, in the low-stage side compression chamber (51), the intermediate-pressure fluid contained in the intermediate-pressure space (4*b*) and discharged from the high-stage side compression chamber (52) is introduced.

According to the fifth aspect of the present invention, an intermediate-pressure fluid compressed in the low-stage side compression chamber (51) flows into the intermediate-pressure space (4*b*), and the intermediate-pressure fluid in the intermediate-pressure space (4*b*) flows into the high-stage side compression chamber (52) and is further compressed into a high-pressure fluid. Thereafter, a high-pressure fluid discharged from the high-stage side compression chamber (52) flows into the high-pressure space (4*a*).

The invention according to a sixth aspect provides the rotary compressor of the fifth aspect, wherein the intermediate-pressure space (4*b*) is formed below the high-pressure space (4*a*), and the casing (10) includes an oil return passage (80) through which the high-pressure space (4*a*) communicates with the intermediate-pressure space (4*b*).

According to the sixth aspect of the present invention, lubrication oil is isolated from a fluid in the high-pressure space (4*a*) of the casing (10), and the isolated lubrication oil passes through the oil return passage (80) and returns to the intermediate-pressure space (4*b*).

The invention according to a seventh aspect provides the rotary compressor of the first aspect further comprising a driving mechanism (30) for driving the rotation mechanism (20). The driving mechanism (30) includes a stator (32), a rotor (31) and a drive shaft (33) coupled to the rotor (31), the drive shaft (33) includes an eccentric part (35) that is eccentric from the center of rotation, and the eccentric part (35) is coupled to the rotor (20). A part of the drive shaft (33) located to both axial sides of the eccentric part (35) is supported via bearing parts (18, 19) in a casing (10).

According to the seventh aspect of the present invention, since parts of the drive shaft (33) located to both axial sides of the eccentric part (35) are supported via the bearing parts (18, 19) in the casing (10), this can restrain the sliding portion from being partially pressed against the upper housing (16) or the lower housing (17).

The invention according to an eighth aspect provides the rotary compressor of the first aspect, wherein the piston (22) has a shape of C obtained by cutting an annular ring, the blade (23) extends from the inner peripheral wall surface of the cylinder chamber (50) to the outer peripheral wall surface thereof and passes through the cut part of the piston (22). Swing bushes (27) coming in surface contact with the piston (22) and the blade (23) are disposed in the cut part of the piston (22) such that the blade (23) is reciprocatable and the blade (23) is swingable relative to the piston (22).

According to the eighth aspect of the present invention, a blade (23) produces a reciprocating motion (back- and forth-motion) in between swing bushes (27) and swings relative to a piston (22) together with the swing bushes (27). In view of the above, the cylinder (21) revolves while swinging relative to the piston (22). In this way, the rotation mechanism (20) performs a predetermined compression operation.

EFFECTS OF THE INVENTION

In view of the above, according to this embodiment, the two compression chambers (51, 52) are formed outside and inside the piston (22), respectively. Therefore, the whole device can be downsized.

Since the low-stage side compression chamber (51) and the high-stage side compression chamber (52) are adjacent to each other in the same plane, some components can be shared by the low-stage side compression chamber (51) and the high-stage side compression chamber (52), resulting in the reduced number of components.

According to the second aspect of the present invention, since the low-stage side compression chamber (51) and the high-stage side compression chamber (52) are formed outside and inside the piston (22), respectively, the volume of the high-stage side compression chamber (52) inevitably becomes smaller than that of the low-stage side compression chamber (51). As a result, the low-stage side compression chamber (51) and the high-stage side compression chamber (52) have substantially the same maximum compression torque, resulting in reduced vibration and reduced noises.

According to the third aspect of the present invention, since the gas injection pipe (1*c*) through which a gas is injected into the intermediate-pressure space (4*b*) is provided, an external pipe can be omitted. As a result, the pressure loss can be reduced, resulting in an achieved high-efficiency cycle.

Furthermore, since the intermediate-pressure space (4*b*) is formed inside the casing (10), the pressure applied to the casing (10) can be reduced, leading to the facilitated design of compressors.

According to the fourth aspect of the present invention, since the rotation of the driving mechanism (30) is controlled, the amount of a refrigerant flowing through the low-stage side compression chamber (51) and the high-stage side compression chamber (52) can be controlled. Cost for consumed power or any other cost can be reduced while advantage is taken of high-performance two-stage compression.

According to the fifth aspect of the present invention, the inside of the casing (10) is sectioned into the intermediate-pressure space (4*b*) and the high-pressure space (4*a*), and the intermediate-pressure space (4*b*) can be formed adjacent to the rotation mechanism (20). This can reduce the degree of superheat caused by suction, resulting in the enhanced efficiency.

Furthermore, since the intermediate-pressure space (4*b*) is formed inside the casing (10), the pressure applied to the casing (10) can be reduced, leading to the facilitated design of compressors.

According to the sixth aspect of the present invention, since the oil return passage (80) is provided, lubrication oil can be certainly returned to the bottom of the casing (10), resulting in the prevented lubrication malfunction. Furthermore, since oil is isolated from a refrigerant in the high-pressure space (4*a*), this can restrain lubrication oil from being discharged together with a refrigerant, i.e., suppress a leakage of lubrication oil.

According to the seventh aspect of the present invention, since parts of the drive shaft (33) located to both axial sides of the eccentric part (35) are supported via the bearing parts (18, 19) in the casing (10), this can restrain the sliding portion from being partially pressed against the upper housing (16) or the lower housing (17), resulting in the improved reliability.

According to the eighth aspect of the present invention, since the swing bushes (27) are provided as coupling members through which the piston (22) and the blade (23) are coupled to each other and the swing bushes (27) are configured to be substantially in surface contact with the piston (22) and the blade (23), this can prevent the wearing-away of the piston (22) and the blade (23) during operation and the burning of contact portions thereof.

Since the swing bushes (27) are provided in surface contact with the piston (22) and the blade (23), this allows portions of the swing bushes (27) making contact with the piston (22) and the blade (23) to have an excellent sealing function. This can certainly prevent a leak of a refrigerant from the low-stage side compression chamber (51) and the high-stage side compression chamber (52), leading to the prevented reduction in compression efficiency.

Since the blade (23) is formed continuously with the cylinder (21) and supported at both its ends by the cylinder (21), it is less likely to apply an abnormal concentrated load to the blade (23) during operation and cause stress concentration. In view of the above, the sliding portion is less likely to be damaged. This enhances the reliability of a mechanism.

DETAILED DESCRIPTION OF THE INVENTION

Figure 1:
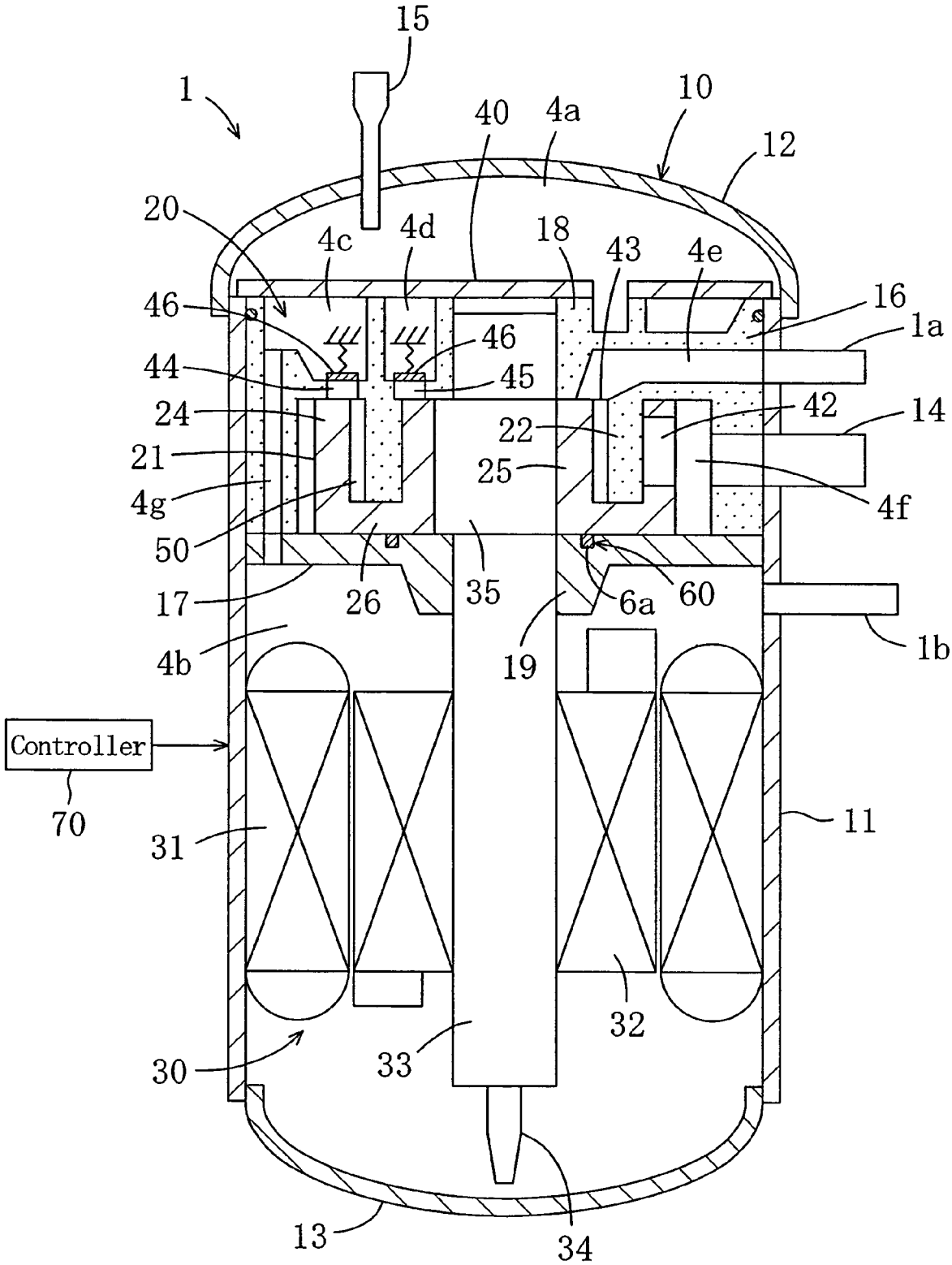
FIG. 1 is a longitudinal cross-sectional view illustrating a compressor according to a first embodiment of the present invention.

Embodiments of the present invention will be described hereinafter with reference to the drawings.

Embodiment 1 of Invention

In this embodiment, as illustrated in FIGS. 1 through 4, a rotary compressor (1) of the present invention is applied to a refrigerant circuit (100) of a vapor compression type refrigerating cycle. The rotary compressor (1) is configured to include a low-stage side compression chamber (51) and a high-stage side compression chamber (52) and compress a refrigerant in two stages.

Figure 4:
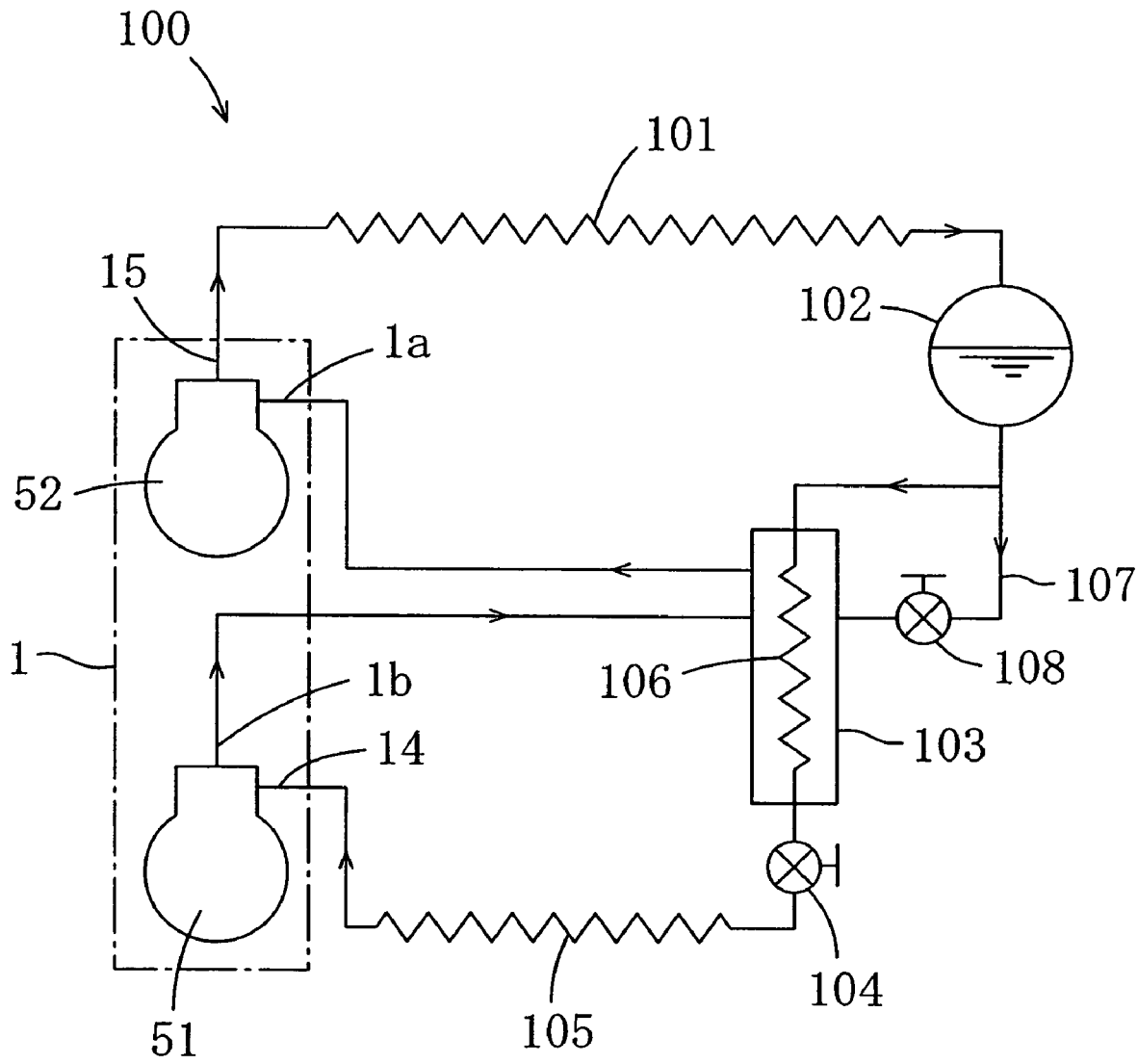
FIG. 4 is a circuit diagram illustrating a refrigerant circuit having the compressor of the first embodiment.

As illustrated in FIG. 4, the refrigerant circuit (100) uses, for example, carbon dioxide ($CO_2$) or the like as a refrigerant and is configured to have a two-stage compression and one-stage expansion cycle. The refrigerant circuit (100) is configured such that a compressor (1), a condenser (101), a receiver (102), an intercooler (103), a main expansion valve (104), and an evaporator (105) are connected through a refrigerant pipe in this order. The intercooler (103) includes a cooling heat exchanger (106), and the low-stage side compression chamber (51) and the high-stage side compression chamber (52) are connected through the intercooler (103) to each other. Furthermore, the intercooler (103) is connected with a branch pipe (107) to which part of a liquid refrigerant from the receiver (102) is led, and the branch pipe (107) is provided with a branch expansion valve (108).

In the refrigerant circuit (100), a high-pressure refrigerant discharged from the high-stage side compression chamber (52) of the compressor (1) is condensed by the condenser (101), and then the condensed refrigerant flows into the receiver (102). The liquid refrigerant in this receiver (102) passes through the cooling heat exchanger (106) and is expanded in the main expansion valve (104), and the expanded liquid refrigerant is evaporated by the evaporator (105) and flows into the low-stage side compression chamber (51) of the compressor (1). Meanwhile, an intermediate-pressure refrigerant compressed in the low-stage side compression chamber (51) flows into the intercooler (103), and part of the liquid refrigerant from the receiver (102) is expanded in the branch expansion valve (108) and then flows into the intercooler (103). In this intercooler (103), the intermediate-pressure refrigerant from the low-stage side compression chamber (51) is cooled, and the liquid refrigerant flowing through the cooling heat exchanger (106) is cooled. The intermediate-pressure refrigerant cooled in the intercooler (103) is returned to the high-stage side compression chamber (52) and compressed into a high-pressure refrigerant. The aforementioned operations are repeatedly carried out, thereby cooling room air, for example, by the evaporator (105).

The rotary compressor (1) is configured to contain a compression mechanism (20) and a motor (30) in a casing (10) and thus take on a hermetic structure.

The casing (10) is composed of a cylindrical barrel (11), an upper end plate (12) fixed to the upper end of the barrel (11), and a lower end plate (13) fixed to the lower end of the barrel (11). The barrel (11) is provided with a suction pipe (14), an inflow pipe (1*a*) and an outflow pipe (1*b*) all penetrating the barrel (11). The suction pipe (14) is connected to the evaporator (105), and the inflow pipe (1*a*) and the outflow pipe (1*b*) are connected to the intercooler (103). Furthermore, the upper end plate (12) is provided with a discharge pipe (15) penetrating the end plate (12). The discharge pipe (15) is connected to the condenser (101).

The motor (30) includes a stator (31) and a rotor (32) and forms a driving mechanism. The stator (31) is placed below the compression mechanism (20) and fixed to the barrel (11) of the casing (10). A drive shaft (33) is coupled to the rotor (32) and configured to rotate together with the rotor (32).

The drive shaft (33) is provided with an oil-supply passage (not shown) extending axially within the drive shaft (33). An oil-supply pump (34) is disposed at the lower end of the drive shaft (33). The oil-supply passage extends upwardly from the oil-supply pump (34). Lubrication oil accumulated in the bottom portion of the casing (10) is supplied through the oil-supply passage to a sliding portion of the compression mechanism (20) by the oil-supply pump (34).

An upper part of the drive shaft (33) is formed with an eccentric part (35). The eccentric part (35) is formed to have a larger diameter than parts of the drive shaft (33) located above and below the eccentric part (35) and is eccentric from the center of the drive shaft (33) by a predetermined amount.

The compression mechanism (20) forms a rotation mechanism and is constructed between an upper housing (16) and a lower housing (17) both fixed in the casing (10).

Figure 2:
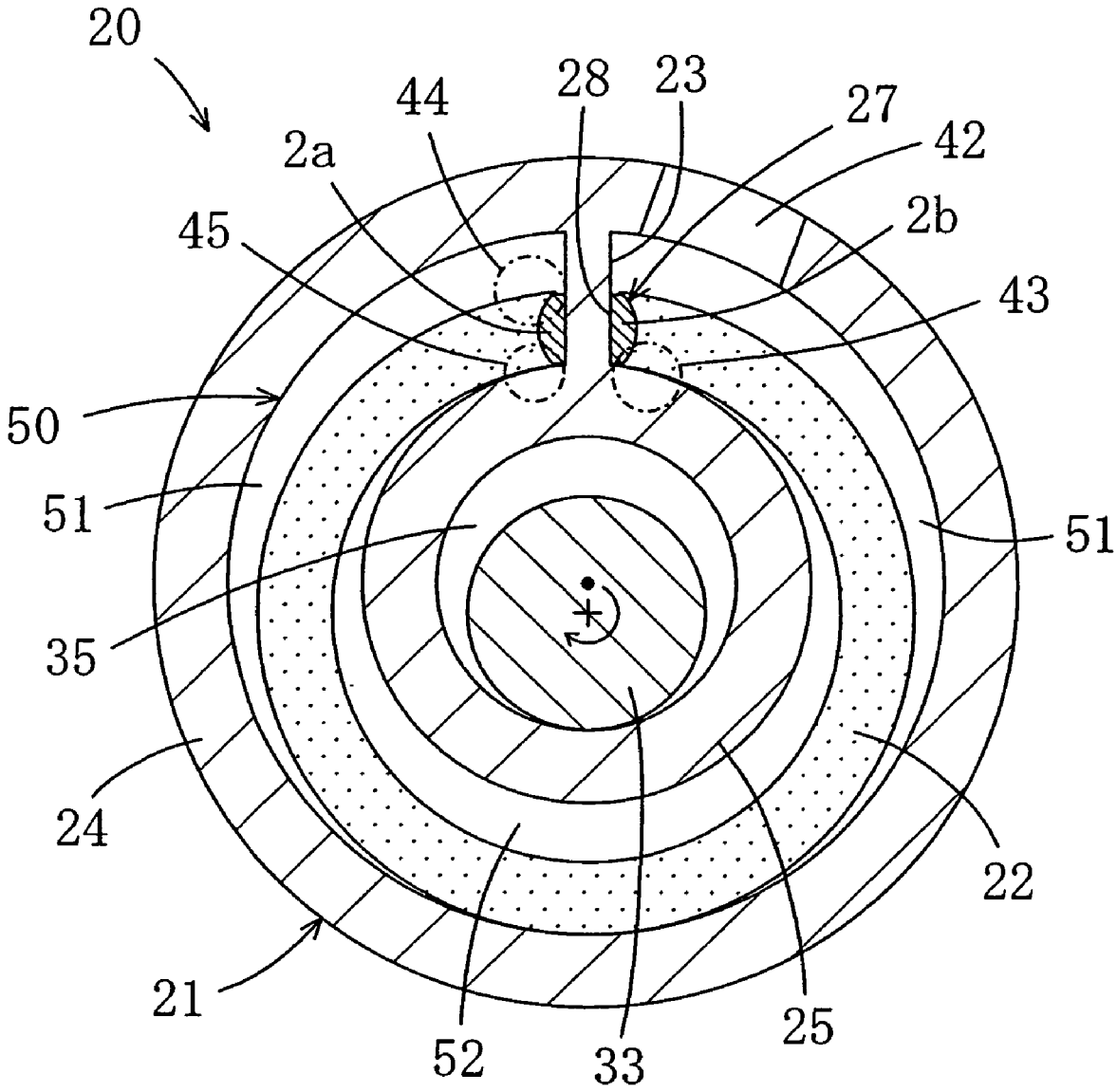
FIG. 2 is a transverse cross-sectional view illustrating a compression mechanism of the first embodiment.

The compression mechanism (20) includes a cylinder (21) having an annular cylinder chamber (50), an annular piston (22) disposed in the cylinder chamber (50) and sectioning the cylinder chamber (50) into the low-stage side compression chamber (51) and the high-stage side compression chamber (52), and a blade (23) sectioning each of the low-stage side compression chamber (51) and the high-stage side compression chamber (52) into a high-pressure side and a low-pressure side as illustrated in FIG. 2. The piston (22) is configured to rotate eccentrically relative to the cylinder (21) within the cylinder chamber (50). In other words, the piston (22) and the cylinder (21) rotate eccentrically relative to each other. In the first embodiment, the cylinder (21) having the cylinder chamber (50) forms movable one of cooperating members, and the piston (22) disposed in the cylinder chamber (50) forms fixed one of the cooperating members.

The cylinder (21) includes an outer cylinder (24) and an inner cylinder (25). The outer cylinder (24) and the inner cylinder (25) are coupled at their lower ends through an end plate (26) to each other so as to be integrated. The inner cylinder (25) is slidably fitted to the eccentric part (35) of the drive shaft (33). In other words, the drive shaft (33) vertically passes through the cylinder chamber (50).

The piston (22) is formed continuously with the upper housing (16). The upper housing (16) and the lower housing (17) are formed with bearing parts (18, 19) serving as bearing members for supporting the drive shaft (33), respectively. In view of the above, the compressor (1) of this embodiment takes on a through-axis structure in which the drive shaft (33) vertically passes through the cylinder chamber (50) and parts of the drive shaft (33) located to both axial sides of the eccentric part (35) are supported via the bearing parts (18, 19) in the casing (10).

The compression mechanism (20) includes swing bushes (27) through which the piston (22) and the blade (23) are movably coupled to each other. The piston (22) has a shape of C obtained by cutting an annular ring. The blade (23) is configured to extend from an inner peripheral wall surface of the cylinder chamber (50) to an outer peripheral wall surface thereof while being inserted through the cut part of the piston (22) in a radial direction of the cylinder chamber (50) and fixed to the outer cylinder (24) and the inner cylinder (25). The swing bushes (27) serve as coupling members through which the piston (22) and the blade (23) are coupled to each other in the cut part of the piston (22).

The inner peripheral surface of the outer cylinder (24) and the outer peripheral surface of the inner cylinder (25) represent concentrically disposed cylindrical surfaces, and a single cylinder chamber (50) is formed therebetween. The piston (22) is formed such that its outer peripheral surface has a smaller diameter than the inner peripheral surface of the outer cylinder (24) and its inner peripheral surface has a larger diameter than the outer peripheral surface of the inner cylinder (25). Thus, a low-stage side compression chamber (51) serving as an operating chamber is formed between the outer peripheral surface of the piston (22) and the inner peripheral surface of the outer cylinder (24), and a high-stage side compression chamber (52) serving as an operating chamber is formed between the inner peripheral surface of the piston (22) and the outer peripheral surface of the inner cylinder (25).

When the outer peripheral surface of the piston (22) substantially makes contact with the inner peripheral surface of the outer cylinder (24) at one point (strictly speaking, there is a gap on the order of microns but no significant leak of a refrigerant from the gap), the inner peripheral surface of the piston (22) substantially makes contact with the outer peripheral surface of the inner cylinder (25) at one point having a phase difference of 180 degrees from the point at which the outer peripheral surface of the piston (22) makes contact with the inner peripheral surface of the outer cylinder (24).

The swing bushes (27) represent a discharge-side bush (2*a*) located to the discharge side of the blade (23) and a suction-side bush (2*b*) located to the suction side of the blade (23). The discharge-side bush (2*a*) and the suction-side bush (2*b*) are formed in the same shape to both have generally semicircular cross sections and disposed to oppose their flat surfaces to each other. A space between the opposed surfaces of the discharge-side bush (2*a*) and suction-side bush (2*b*) forms a blade groove (28).

The blade (23) is inserted into the blade groove (28). The flat surfaces of the swing bushes (27) are substantially in surface contact with the blade (23), and arc-shaped outer peripheral surfaces of the swing bushes (27) are substantially in surface contact with the piston (22). The swing bushes (27) are configured such that the blade (23) moves forward and backward within the blade groove (28) along the surfaces of the blade (23) with the blade (23) caught in the blade groove (28). At the same time, the swing bushes (27) are configured to swing relative to the piston (22) together with the blade (23). In other words, the swing bushes (27) are configured such that the blade (23) and the piston (22) are swingable relative to each other with the central point between the swing bushes (27) as the swing center and the blade (23) is reciprocatable relative to the piston (22) along the surfaces of the blade (23).

Although in this embodiment the discharge-side bush (2*a*) and suction-side bush (2*b*) are independent of each other, both the bushes (2*a*, 2*b*) may be partly coupled to each other so as to be integrated.

With the above structure, the rotation of the drive shaft (33) allows the outer cylinder (24) and the inner cylinder (25) to swing with the central point between the swing bushes (27) as the swing center while the blade (23) moves forward and backward within the blade groove (28). This swing action allows the contact points between the piston (22) and the cylinder (21) to move in the following order: FIG. 3(A), FIG. 3(B), FIG. 3(C), and FIG. 3(D). In this case, the outer cylinder (24) and the inner cylinder (25) move around the drive shaft (33) but do not rotate.

Furthermore, the volume of the low-stage side compression chamber (51) outside the piston (22) is reduced in the order of FIGS. 3(C), 3(D), 3(A), and 3(B). The volume of the high-stage side compression chamber (52) inside the piston (22) is reduced in the order of FIGS. 3(A), 3(B), 3(C), and 3(D).

An upper cover plate (40) is placed on the upper housing (16). In the casing (10), a space located above the upper cover plate (40) is formed as a high-pressure space (4*a*), and a space located below the lower housing (17) is formed as an intermediate-pressure space (4*b*). One end of the discharge pipe (15) is open to the high-pressure space (4*a*), and one end of the outflow pipe (1*b*) is open to the intermediate-pressure space (4*b*).

An intermediate-pressure chamber (4*c*) and a high-pressure chamber (4*d*) are defined by the upper housing (16) and the upper cover plate (40), and an intermediate-pressure passage (4*e*) is formed in the upper housing (16). A pocket (4*f*) is defined by the upper housing (16) and the lower housing (17) so as to be located on the outer periphery of the outer cylinder (24).

While the inflow pipe (1*a*) is connected to one end of the intermediate-pressure passage (4*e*), the pocket (4*f*) is connected with the suction pipe (14) to have a suction-pressure atmosphere, i.e., a low-pressure atmosphere.

The outer cylinder (24) is formed with a first suction port (42) radially penetrating the outer cylinder (24). In FIG. 2, the first suction port (42) is formed so as to be located to the right side of the blade (23). The first suction port (42) of the outer cylinder (24) allows the low-stage side compression chamber (51) to communicate with the pocket (4*f*). This allows the low-stage side compression chamber (51) to communicate with the suction pipe (14).

A second suction port (43) is formed at the other end of the intermediate-pressure passage (4*e*). The second suction port (43) is formed so as to be located to the right side of the blade (23) and open to the high-stage side compression chamber (52) and allows the high-stage side compression chamber (52) to communicate with the immediate-pressure space (4*b*).

The upper housing (16) is formed with a first discharge port (44) and a second discharge port (45). Both the discharge ports (44, 45) axially penetrate the upper housing (16). While one end of the first discharge port (44) is exposed to the high-pressure side of the low-stage side compression chamber (51), the other end thereof communicates with the intermediate-pressure chamber (4*c*). While one end of the second discharge port (44) is exposed to the high-pressure side of the high-stage side compression chamber (52), the other end thereof communicates with the high-pressure chamber (4*d*). Discharge valves (46) serving as reed valves for opening and closing the discharge ports (44, 45) are placed at the outer ends of the first discharge port (44) and the second discharge port (45).

The immediate-pressure chamber (4*c*) and the immediate-pressure space (4*b*) communicate with each other through a communication passage (4*g*) formed in the upper housing (16) and the lower housing (17). Although not shown, the high-pressure chamber (4*d*) communicates with the high-pressure space (4*a*) through a high-pressure passage formed in the upper cover plate (40).

A seal ring (6*a*) is disposed in the lower housing (17). The seal ring (6*a*) is inserted into an annular groove of the lower housing (17) and pressed against the lower surface of the end plate (26) of the cylinder (21). Furthermore, intermediate-pressure lubrication oil is introduced onto the surface of the lower housing (17) coming into contact with the cylinder (21) and radially inside the seal ring (6*a*). With the above structure, the seal ring (6*a*) forms a compliance mechanism (60) for adjusting an axial location of the cylinder (21), and axial gaps among the piston (22), the cylinder (21) and the upper housing (16) are made smaller.

The motor (30) is configured such that its rotation speed is controlled by a controller (70) having a control circuit, such as an inverter.

—Running Operation—

Next, an operation of the compressor (1) will be described.

The startup of a motor (30) allows the rotation of a rotor (32) to transmit through a drive shaft (33) to an outer cylinder (24) and an inner cylinder (25) of a compression mechanism (20). Then, a blade (23) produces a reciprocating motion (back- and forth-motion) in between swing bushes (27) and swings relative to a piston (22) together with the swing bushes (27). In view of the above, the outer cylinder (24) and the inner cylinder (25) revolve around the piston (22) while swinging relative to the piston (22). In this way, the compression mechanism (20) performs a predetermined compression operation.

Figure 3A:
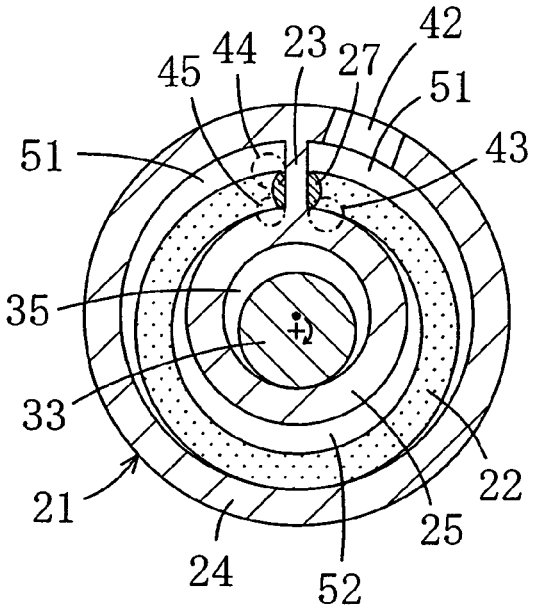
FIG. 3 is a transverse cross-sectional view illustrating an operation of the compression mechanism of the first embodiment.
Figure 3D:
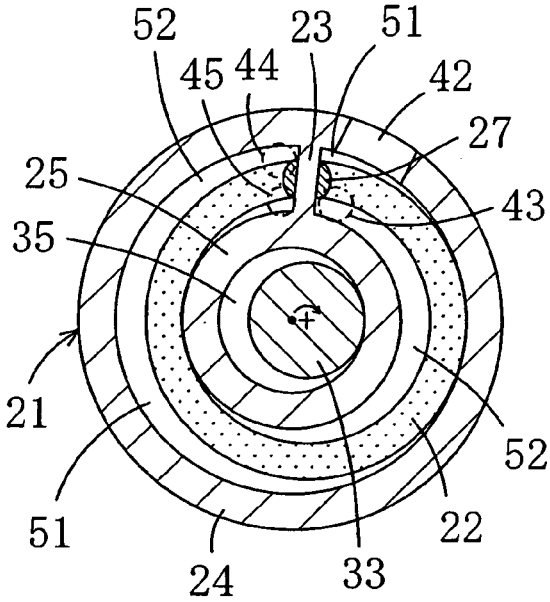
Figure 3B:
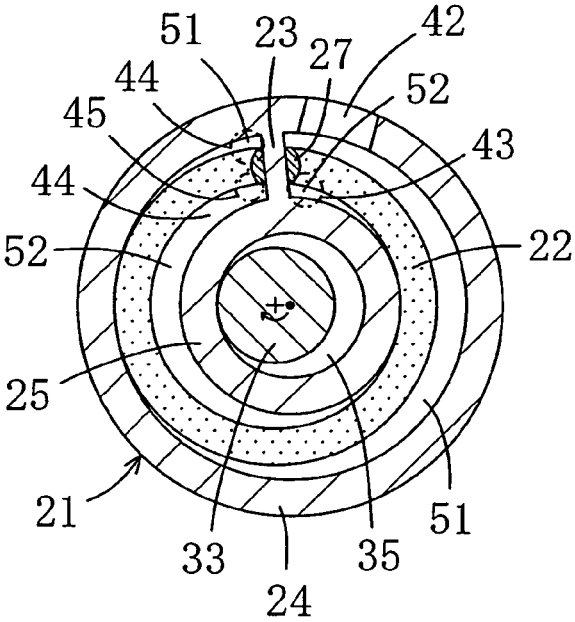
Figure 3C:
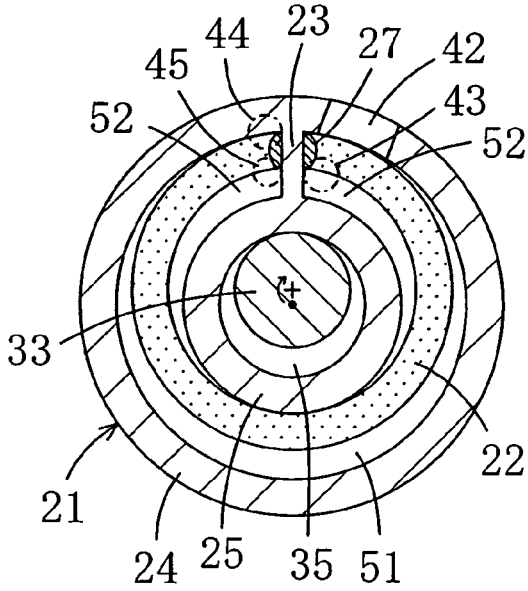

To be specific, when the drive shaft (33) rotates clockwise from the state in which the piston (22) is located at top dead center as illustrated in FIG. 3(C), a suction step is started in a low-stage side compression chamber (51). The state illustrated in FIG. 3(C) changes to the states shown in FIGS. 3(D), 3(A) and 3(B). Thus, the volume of the low-stage side compression chamber (51) is increased, and a low-pressure refrigerant is sucked through a suction pipe (14), a pocket (4*f*) and a first suction port (42) into the low-stage side compression chamber (51).

In the state in which the piston (22) is located at top dead center as illustrated in FIG. 3(C), a single low-stage side compression chamber (51) is formed outside the piston (22). In this state, the low-stage side compression chamber (51) has substantially the maximum volume. As the clockwise rotation of the drive shaft (33) allows this state to sequentially change to the states illustrated in FIGS. 3(D), 3(A) and 3(B), the volume of the low-stage side compression chamber (51) is reduced to compress a refrigerant. When the low-stage side compression chamber (51) has a predetermined intermediate pressure and thus a difference in pressure between the low-stage side compression chamber (51) and the intermediate-pressure chamber (4*c*) reaches a set value, associated one of discharge valves (46) is opened by an intermediate-pressure refrigerant in the low-stage side compression chamber (51), the intermediate-pressure refrigerant is discharged to the intermediate-pressure chamber (4*c*), and then flows out of the intermediate-pressure space (4*b*) into an inflow pipe (1*b*).

On the other hand, when the drive shaft (33) rotates clockwise from the state in which the piston (22) is located at bottom dead center as illustrated in FIG. 3(A), a suction step is started in a high-stage side compression chamber (52). The state illustrated in FIG. 3(A) changes to the states shown in FIGS. 3(B), 3(C) and 3(D). Thus, the volume of the high-stage side compression chamber (52) is increased, and an intermediate-pressure refrigerant is sucked through an inflow pipe (1*a*), an intermediate-pressure passage (4*e*) and a second suction port (43) into the high-stage side compression chamber (52).

In the state in which the piston (22) is located at bottom dead center as illustrated in FIG. 3(A), a single high-stage side compression chamber (52) is formed inside the piston (22). In this state, the high-stage side compression chamber (52) has substantially the maximum volume. As the clockwise rotation of the drive shaft (33) allows this state to sequentially change to the states illustrated in FIGS. 3(B), 3(C) and 3(D), the volume of the high-stage side compression chamber (52) is reduced to compress a refrigerant. When the high-stage side compression chamber (52) has a predetermined high pressure and thus a difference in pressure between the high-stage side compression chamber (52) and the high-pressure chamber (4*d*) reaches a set value, discharge valves (46) are opened by an high-pressure refrigerant in the high-stage side compression chamber (52), the high-pressure refrigerant is discharged to the high-pressure chamber (4*d*), and the discharged high-pressure refrigerant flows out of the high-pressure space (4*a*) into a discharge pipe (1*b*).

In the refrigerant circuit (100), the high-pressure refrigerant discharged from the high-pressure side compression chamber (52) of the compressor (1) is condensed by the condenser (101) and then flows into a receiver (102). The resultant liquid refrigerant in this receiver (102) passes through a cooling heat exchanger (106) and expands through the main expansion valve (104), and the expanded liquid refrigerant is evaporated by the evaporator (105) and flows into the low-stage side compression chamber (51) of the compressor (1). Meanwhile, an intermediate-pressure refrigerant compressed in the low-stage side compression chamber (51) flows into an intercooler (103), and part of the liquid refrigerant from the receiver (102) expands through a branch expansion valve (108) and then flows into the intercooler (103). In this intercooler (103), the intermediate-pressure refrigerant from the low-stage side compression chamber (51) is cooled, and the liquid refrigerant flowing through the cooling heat exchanger (106) is also cooled. The intermediate-pressure refrigerant cooled by the intercooler (103) is returned to the high-stage side compression chamber (52) and compressed into a high-pressure refrigerant. The aforementioned operations are repeatedly carried out, thereby cooling room air, for example, by the evaporator (105).

—Effects of Embodiment—

As described above, according to this embodiment, the low-stage side compression chamber (51) and the high-stage side compression chamber (52) are formed outside and inside the piston (22), respectively. Therefore, the whole compressor can be downsized.

Since the low-stage side compression chamber (51) and the high-stage side compression chamber (52) are located adjacent to each other in the same plane, some components can be shared by the low-stage side compression chamber (51) and the high-stage side compression chamber (52), resulting in the reduced number of components.

Furthermore, since the low-stage side compression chamber (51) and the high-stage side compression chamber (52) are formed outside and inside the piston (22), respectively, the volume of the high-stage side compression chamber (52) inevitably becomes smaller than that of the low-stage side compression chamber (51). As a result, the low-stage side compression chamber (51) and the high-stage side compression chamber (52) have substantially the same maximum compression torque, resulting in reduced vibration and reduced noises.

Since the rotation of the motor (30) is controlled by the controller (70), the amount of a refrigerant flowing through the low-stage side compression chamber (51) and the high-stage side compression chamber (52) can be controlled. Cost for consumed power or any other cost can be reduced while advantage is taken of high-performance two-stage compression.

Since the high-pressure space (4*a*) is defined by the upper cover plate (40), distortion of the upper housing (16) or any other component can be avoided. As a result, the leak of a refrigerant due to the distortion and mechanical losses can be reduced, resulting in the enhanced efficiency.

The inside of the casing (10) is sectioned into the intermediate-pressure space (4*b*) and the high-pressure space (4*a*), and the intermediate-pressure space (4*b*) can be formed adjacent to the compression mechanism (20). This can reduce the degree of superheat caused by suction, resulting in the enhanced efficiency.

Since the intermediate-pressure space (4*b*) is formed inside the casing (10), the pressure applied to the casing (10) can be reduced, leading to the facilitated design of compressors.

Since the swing bushes (27) serve as coupling members through which the piston (22) and the blade (23) are coupled to each other and are configured to be substantially in surface contact with the piston (22) and the blade (23), this can avoid the wearing-away of the piston (22) and the blade (23) during operation and the burning of contact portions thereof.

Since the swing bushes (27) are provided in surface contact with the piston (22) and the blade (23), this allows portions of the swing bushes (27) making contact with the piston (22) and the blade (23) to have an excellent sealing function. This can certainly prevent a leak of a refrigerant from the low-stage side compression chamber (51) and the high-stage side compression chamber (52), leading to the prevented reduction in compression efficiency.

Since the blade (23) is formed continuously with the cylinder (21) and supported at both its ends by the cylinder (21), it is less likely to apply an abnormal concentrated load to the blade (23) during operation and cause stress concentration. In view of the above, the sliding portion is less likely to be damaged. This enhances the reliability of a mechanism.

Since the rotary compressor (1) does not have a rigorous sliding portion, such as a sliding portion composed of a rotor and a vane that come in line contact with each other, this can enhance the reliability of the rotary compressor (1) even with the application of a high-pressure refrigerant, such as $CO_2$.

Furthermore, since parts of the drive shaft (33) located to both axial sides of the eccentric part (35) are supported via the bearing parts (18, 19) in the casing (10), this can restrain the sliding portion from being partially pressed against the upper housing (16) or the lower housing (17), resulting in the improved reliability.

—Variant—

Figure 5:
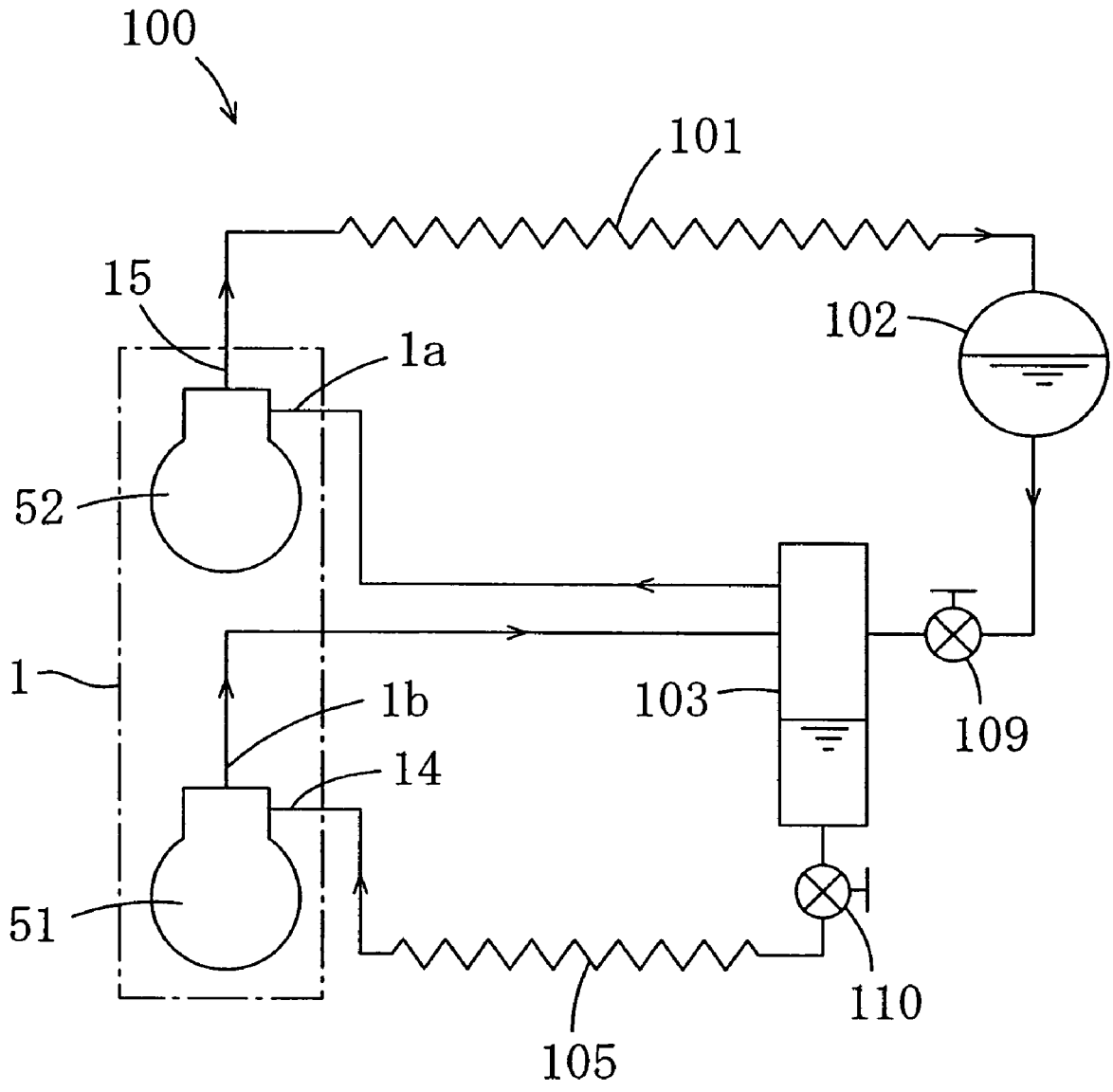
FIG. 5 is a circuit diagram illustrating a variant of the refrigerant circuit of the first embodiment.

The refrigerant circuit (100) of the first embodiment may be configured to have a two-stage compression and two-stage expansion cycle as illustrated in FIG. 5.

The refrigerant circuit (100) is configured such that a compressor (1), a condenser (101), a receiver (102), a first expansion valve (109), an intercooler (103), a second expansion valve (110), and an evaporator (105) are connected through a refrigerant pipe in this order. The intercooler (103) is connected with the low-stage side compression chamber (51) and the high-stage side compression chamber (52).

In the refrigerant circuit (100), a high-pressure refrigerant discharged from the high-stage side compression chamber (52) of the compressor (1) is condensed by the condenser (101) and then flows into the receiver (102). The resultant liquid refrigerant in this receiver (102) is expanded into an intermediate-pressure refrigerant through the first expansion valve (109), and the intermediate-pressure refrigerant passes through the intercooler (103) and expands through the second expansion valve (110). The expanded refrigerant is evaporated by the evaporator (105) and flows into the low-stage side compression chamber (51) of the compressor (1). Meanwhile, an intermediate-pressure refrigerant compressed in the low-stage side compression chamber (51) flows into the intercooler (103) and is cooled therein by the refrigerant expanded through the first expansion valve (109). In addition, liquid refrigerant is also cooled in the intercooler (103). The intermediate-pressure refrigerant cooled by the intercooler (103) is returned to the high-stage side compression chamber (52) and compressed into a high-pressure refrigerant. The aforementioned operations are repeatedly carried out, thereby cooling room air, for example, by the evaporator (105).

Embodiment 2 of Invention

Figure 6:
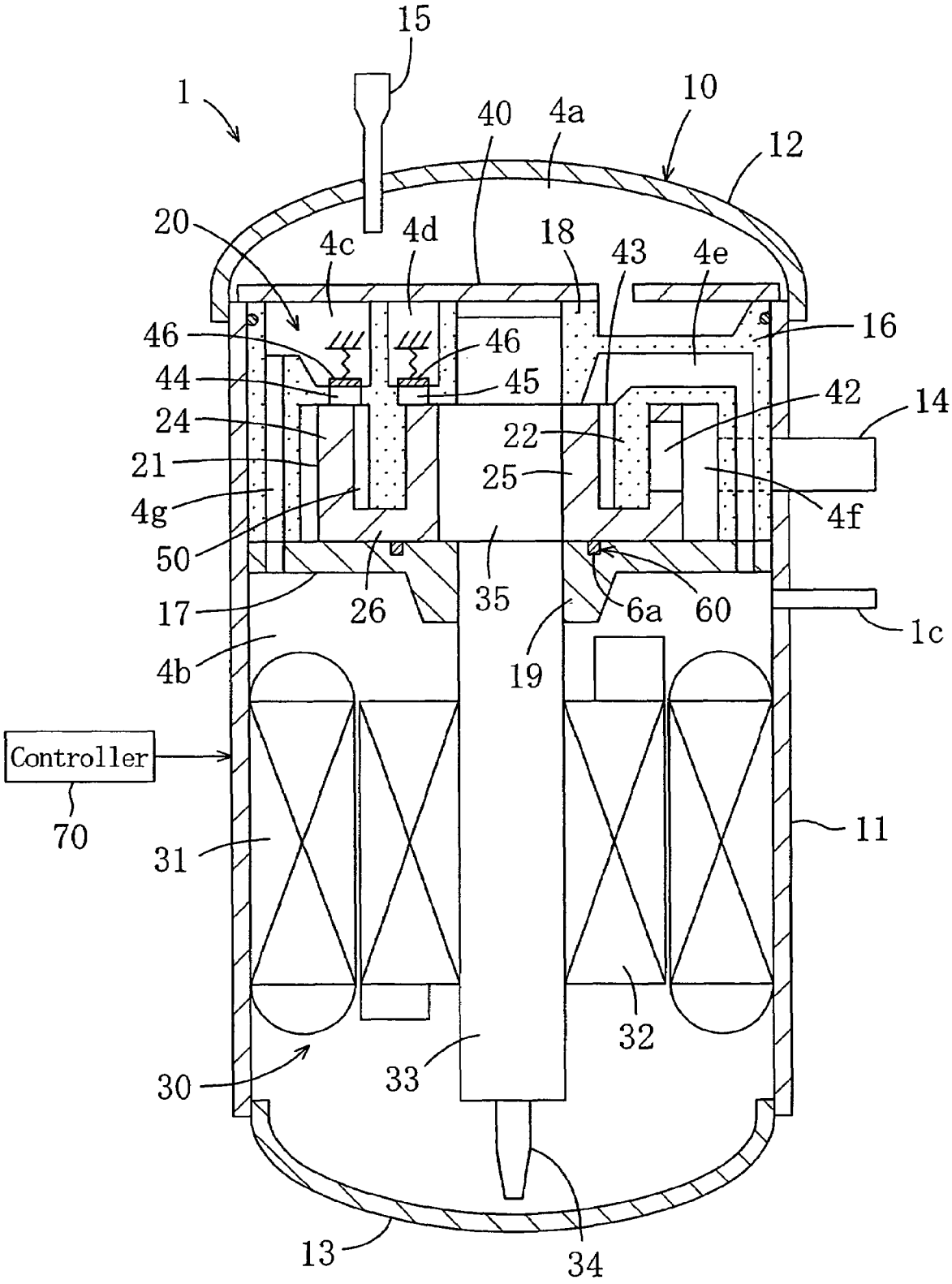
FIG. 6 is a longitudinal cross-sectional view illustrating a compressor according to a second embodiment.

In this embodiment, as illustrated in FIG. 6, a gas injection pipe (1*c*) is provided instead of the inflow pipe (1*a*) and outflow pipe (1*b*) of the first embodiment.

More particularly, the gas injection pipe (1*c*) is connected to the barrel (11) of the casing (10) and communicates with the intermediate-pressure space (4*b*). The gas injection pipe (1*c*) is connected to, for example, the intercooler (103) of the first embodiment in FIG. 5, and an intermediate-pressure refrigerant is led from the intercooler (103) to the intermediate-pressure space (4*b*) of the casing (10).

Meanwhile, in this embodiment, the inflow pipe (1*a*) and outflow pipe (1*b*) of the first embodiment are not provided, and an intermediate-pressure passage (4*e*) is formed to extend across the boundary between the upper housing (16) and the lower housing (17). One end of the intermediate-pressure passage (4*e*) communicates with the intermediate-pressure space (4*b*).

An intermediate-pressure refrigerant compressed in the low-stage side compression chamber (51) flows from the intermediate-pressure chamber (4*c*) into the intermediate-pressure space (4*b*) and then flows through the intermediate-pressure passage (4*e*) into the high-stage side compression chamber (52) so as to be compressed. A gas refrigerant from the intercooler (103) is supplied through the gas injection pipe (1*c*) to the intermediate-pressure refrigerant in the intermediate-pressure space (4*b*) and cooled.

In view of the above, since the gas injection pipe (1*c*) is provided, an external pipe, such as the inflow pipe (1*b*), can be omitted. As a result, the pressure loss can be reduced, resulting in an achieved high-efficiency cycle. The other structure, effects and benefits are similar to those of the first embodiment.

Embodiment 3 of Invention

Figure 7:
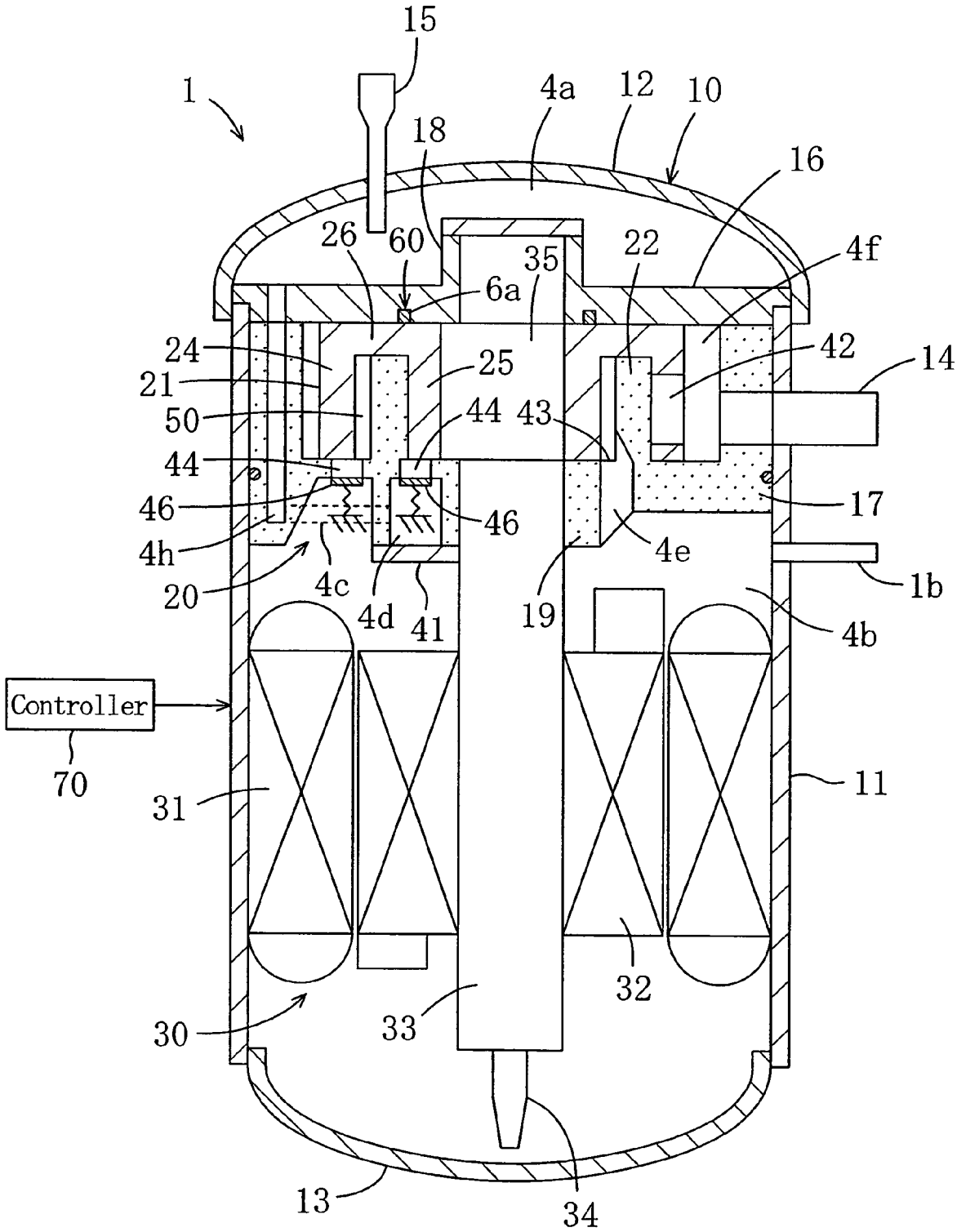
FIG. 7 is a longitudinal cross-sectional view illustrating a compressor according to a third embodiment.

Although in the second embodiment the cylinder chamber (50) of the cylinder (21) is open upwardly, a cylinder chamber (50) of a cylinder (21) of this embodiment is open downwardly as illustrated in FIG. 7. In other words, in this embodiment, the cylinder (21) is oriented upside down from the orientation of the cylinder (21) of the second embodiment.

To be specific, a piston (22) is formed continuously with a lower housing (17). Meanwhile, a lower cover plate (41) is attached to the lower housing (17), and an intermediate-pressure chamber (4*c*), a high-pressure chamber (4*d*) and an intermediate-pressure passage (4*e*) are formed in the lower housing (17).

First and second discharge ports (44) and (45) are formed in the lower housing (17). The first discharge port (44) allows a low-stage side compression chamber (51) to communicate with the intermediate-pressure chamber (4*c*), and the second discharge port (45) allows a high-stage side compression chamber (52) to communicate with the high-pressure chamber (4*d*). The intermediate-pressure chamber (4*c*) communicates with an intermediate-pressure space (4*b*), and the intermediate-pressure passage (4*e*) allows the intermediate-pressure space (4*b*) to communicate with the high-stage side compression chamber (52).

On the other hand, the high-pressure chamber (4*d*) communicates through a high-pressure passage (4*h*) with a high-pressure space (4*a*). The structures of the gas injection pipe (1*c*) and the other components and the other effects and benefits are similar to those of the second embodiment.

Embodiment 4

Figure 8:
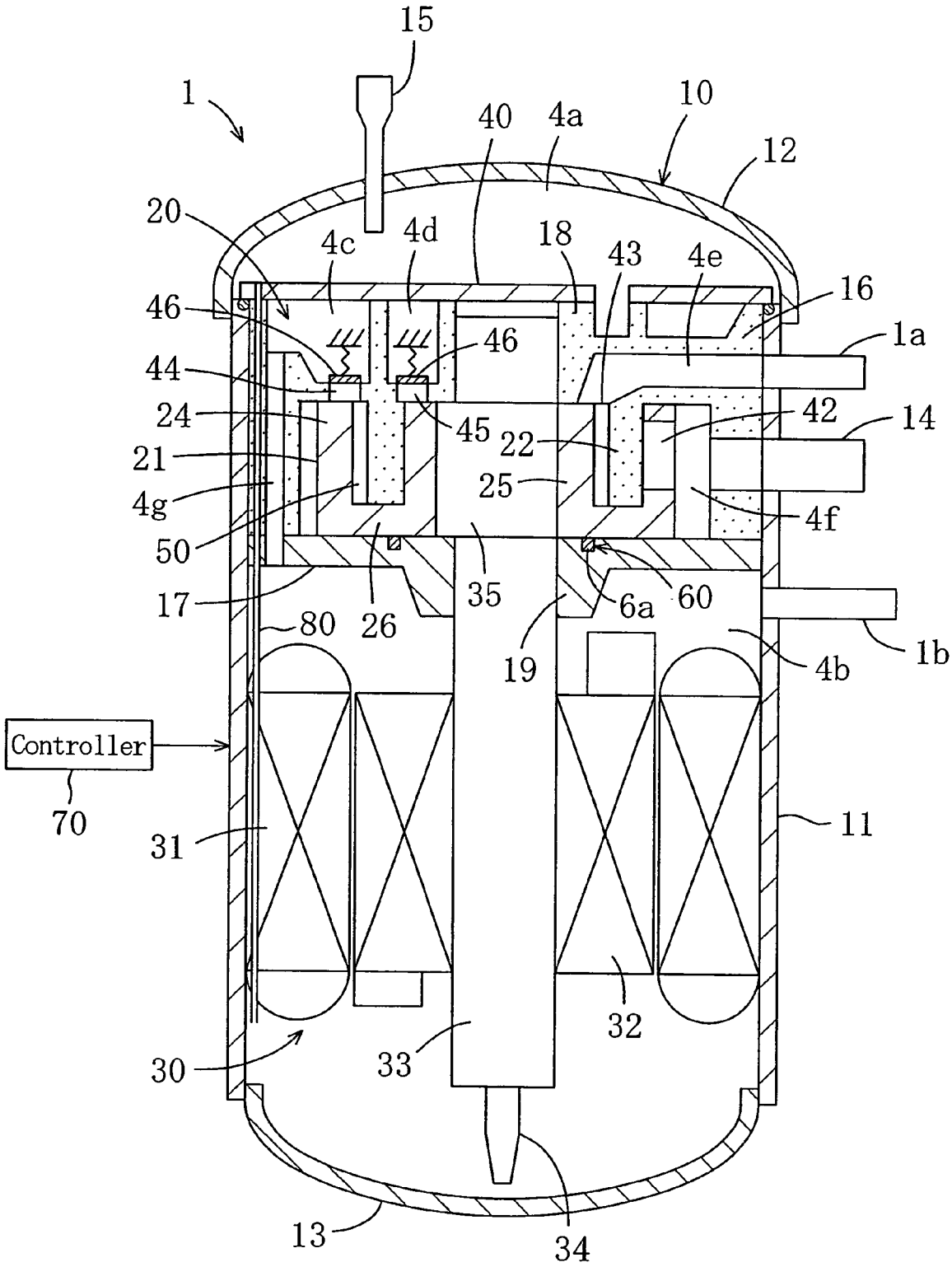
FIG. 8 is a longitudinal cross-sectional view illustrating a compressor according to a fourth embodiment.

In this embodiment, as illustrated in FIG. 8, an oil return passage (80) is added to the first embodiment.

More particularly, the oil return passage (80) is disposed along the barrel (11) of the casing (10). One end of the oil return passage (80) is open through the top surface of the upper cover plate (40). On the other hand, the other end of the oil return passage (80) is open below a stator (32) of the motor (30).

The oil return passage (80) is configured to return lubrication oil isolated from a refrigerant in the high-pressure space (4*a*) to the bottom of the casing (10). More particularly, lubrication oil isolated from a refrigerant in the high-pressure space (4*a*) and allowed to collect on the upper cover plate (40) passes through the oil return passage (80) and returns to the bottom of the casing (10).

In view of the above, since oil is isolated from a refrigerant in the high-pressure space (4*a*), this can restrain lubrication oil from being discharged together with the refrigerant, i.e., suppress a leakage of lubrication oil.

Since the oil return passage (80) is provided, lubrication oil can be certainly returned to the bottom of the casing (10), resulting in the prevented lubrication malfunction. The other structure, effects and benefits are similar to those of the first embodiment.

Embodiment 5 of Invention

Figure 9:
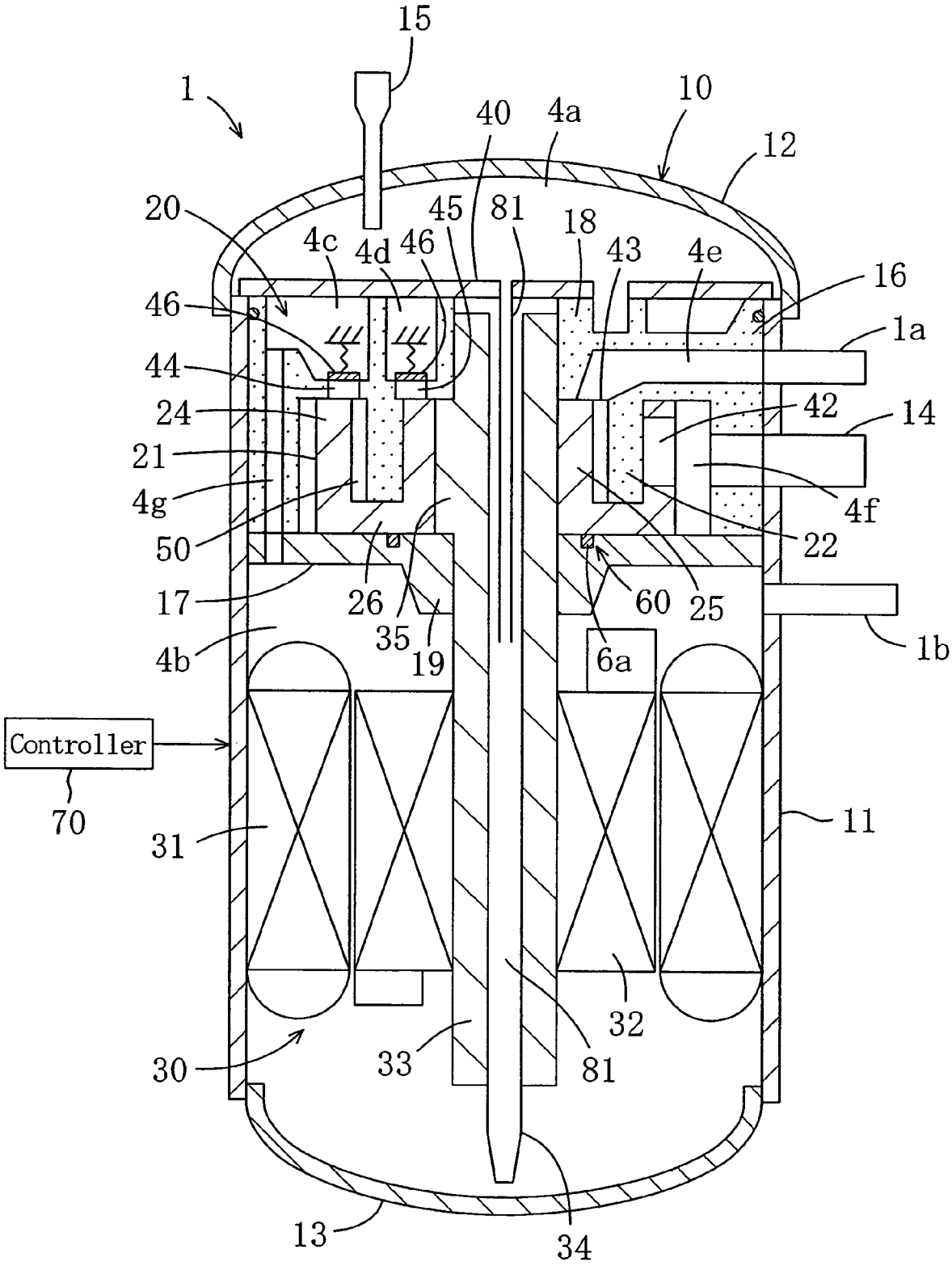
FIG. 9 is a longitudinal cross-sectional view illustrating a compressor according to a fifth embodiment.

Although in the fourth embodiment lubrication oil is returned through the oil return passage (80) to the bottom of the casing (10), it is returned to an oil-supply passage (81) axially extending through the interior of the drive shaft (33) in this embodiment as illustrated in FIG. 9.

More particularly, the oil-supply passage (81) is axially formed inside the drive shaft (33) and configured to supply lubrication oil allowed to collect on the bottom of the casing (10) to a sliding portion of a compression mechanism (20) through an oil-supply pump (34). The oil return passage (80) is introduced into the oil-supply passage (81), one end of the oil return passage (80) is open through the top surface of the upper cover plate (40), and the other end thereof is open to the midpoint of the oil-supply passage (81). In view of the above, lubrication oil isolated from a refrigerant in the high-pressure space (4*a*) and allowed to collect on the upper cover plate (40) passes through the oil return passage (80) and returns to the midpoint of the oil-supply passage (81). The other structure, effects and benefits are similar to those of the fourth embodiment.

Another Embodiment

The present invention may have the following structure in the above embodiments.

For example, a cylinder (21) may be fixed and a piston (22) may be movable.

A cylinder (21) may be integrated by coupling an outer cylinder (24) and an inner cylinder (25) at their upper ends through an end plate (26), and a piston (22) may be formed continuously with a lower housing (17).

Furthermore, while a piston (22) may be formed in complete ring form that is not cut, a blade (23) may be divided into an outer blade (23) and an inner blade (23). In this case, the outer blade (23) may move forward and backward from an outer cylinder and make contact with the piston (22), and the inner blade (23) may move forward and backward from an inner cylinder and make contact with the piston (22).

The refrigerant circuit (100) may provide only heating or be switched between cooling and heating.

Furthermore, a refrigerant for the refrigerant circuit (100) is not limited to $CO_2$.

INDUSTRIAL APPLICABILITY

As described above, the present invention is useful for a rotary compressor for compressing a refrigerant in two stages and suitable for, in particular, a rotary compressor in which a low-stage side compression chamber and a high-stage side compression chamber are formed in the same plane.

What is claimed is:

1. A rotary compressor comprising:

a rotation mechanism including a cylinder having an annular cylinder chamber;

a driving mechanism arranged to drive the rotation mechanism;

a casing containing the rotation mechanism and the driving mechanism;

an annular piston disposed in the cylinder chamber to be eccentric to the cylinder, the annular piston dividing the cylinder chamber into an outer compression chamber and an inner compression chamber; and a blade disposed in the cylinder chamber to divide each of the inner and outer compression chambers into a high-pressure side and a low-pressure side, the rotation mechanism compressing a fluid by relatively rotating the cylinder and the piston, one of the inner and outer compression chambers being a low-stage side compression chamber arranged to compress a low-pressure fluid into an intermediate-pressure fluid, and the other of the inner and outer compression chambers being a high-stage side compression chamber arranged to compress the intermediate-pressure fluid compressed in the low-stage side compression chamber into a high-pressure fluid, the casing having an intermediate-pressure space into which the intermediate-pressure fluid compressed in the low-stage side compression chamber is introduced, with the driving mechanism being disposed in the intermediate-pressure space, and the casing having a gas injection pipe connected to the casing that is configured to accommodate gas that is injected into the intermediate pressure space.

2. The rotary compressor of claim 1, wherein the outer compression chamber serves as the low-stage side compression chamber, and the inner compression chamber serves as the high-stage side compression chamber.

3. The rotary compressor of claim 1, wherein a rotation speed of the driving mechanism is variably controlled.

4. The rotary compressor of claim 1, wherein the casing has a high-pressure space into which the high-pressure fluid is introduced, the high-pressure fluid is obtained by compressing, in the high-stage side compression chamber, the intermediate-pressure fluid contained in the intermediate-pressure space and discharged from the low-stage side compression chamber.

5. The rotary compressor of claim 4, wherein the intermediate-pressure space is formed below the high-pressure space, and the casing includes an oil return passage through which the high-pressure space communicates with the intermediate-pressure space.

6. The rotary compressor of claim 1, wherein the driving mechanism includes a stator, a rotor,, and a drive shaft coupled to the rotor, the drive shaft including an eccentric part that is eccentric from a center of rotation, the eccentric part being coupled to the rotor, and a part of the drive shaft located at both axial sides of the eccentric part being supported via bearing parts in the casing.

7. The rotary compressor of claim 1, wherein the piston is C-shaped to form a gap, the blade extends from an inner peripheral wall surface of the cylinder chamber to an outer peripheral wall surface thereof and passes through the gap of the piston, and the gap has a swing bushing contacting the piston and the blade therein such that the blade is reciprocatable and the blade is swingable relative to the piston.

* * * * *